United States Patent [19]

Wilson

[11] Patent Number: 4,702,375

[45] Date of Patent: Oct. 27, 1987

[54] WRAP-AROUND CARRIER

[75] Inventor: Jerry F. Wilson, West Monroe, La.

[73] Assignee: Manville Corporation, Denver, Colo.

[21] Appl. No.: 794,824

[22] Filed: Nov. 1, 1985

[51] Int. Cl.[4] ..... B65D 71/00

[52] U.S. Cl. ..... 206/434; 206/147; 229/40

[58] Field of Search ..... 206/140, 141, 147, 434, 206/427; 229/40; 294/87.2

[56] References Cited

U.S. PATENT DOCUMENTS

| | | | |
|---|---|---|---|
| 3,384,291 | 5/1968 | Graser | 206/140 |
| 3,424,368 | 1/1969 | Forrer | 229/40 |
| 4,545,485 | 10/1985 | Oliff | 206/427 |

*Primary Examiner*—Jimmy G. Foster

*Attorney, Agent, or Firm*—John D. Lister; Cornelius P. Quinn; Timothy R. Schulte

[57] ABSTRACT

A wrap-around bottle carrier wherein the bottle heel cutouts at the ends of the carrier are spaced from the ends a greater distance than normal to increase the strength of the carrier at this area of stress. To permit this arrangement to be used, the shape of the outer or end cutouts is altered by connecting the top of the cutout to the vertical inner side portion of the cutout by a straight cut rather than by the usual curved cut. This allows the edges of the end cutouts to contact the bottles when the carrier is lifted even though, due to the change in dimensions of the end cutouts, the end cutouts are not symmetrically arranged with respect to the centerline of their associated bottles.

12 Claims, 4 Drawing Figures

Fig. 1.
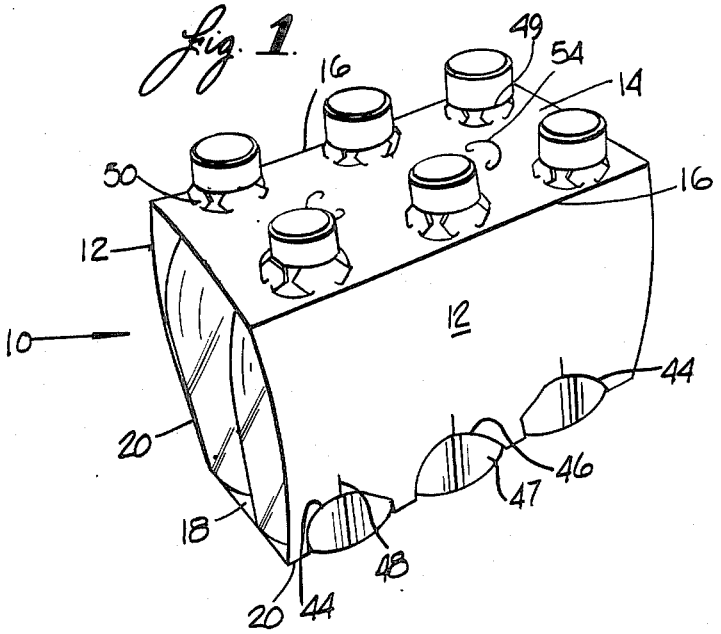
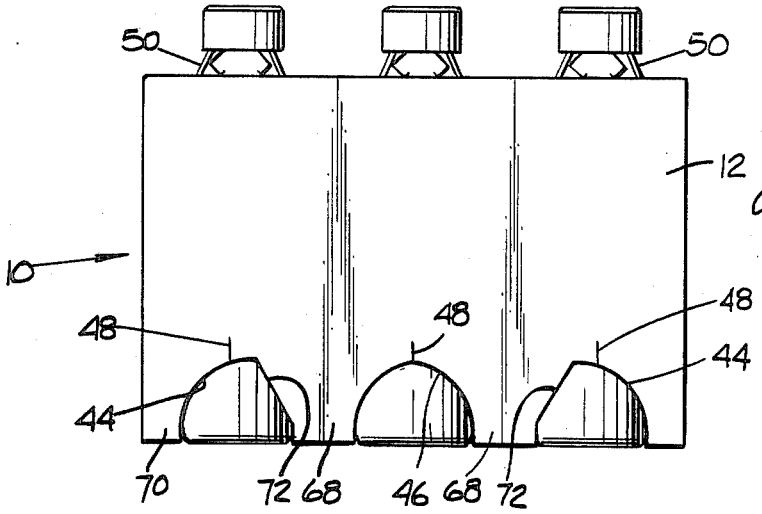
Fig. 3.
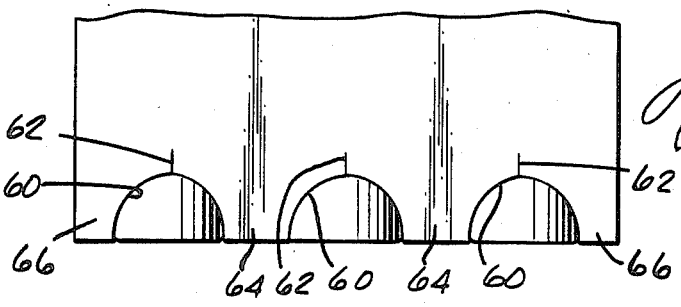
Fig. 4.
(PRIOR ART)

WRAP-AROUND CARRIER

FIELD OF THE INVENTION

This invention relates to a wrap-around article carrier, and more particularly to a wrap-around article carrier having an improved heel cutout arrangement for receiving the bottom portions of bottles or other articles having cylindrical lower portions.

BACKGROUND OF THE INVENTION

One type of carrier for articles such as bottles is formed from blanks of paperboard sheet stock which are wrapped around the articles by a packaging machine. Typically, the articles are encased by two side panels and top and bottom panels foldably connected to the side panels. The ends of the package are open. The package is adapted to be lifted by finger holes or other type of handle integrally formed in the top panel. Openings are provided in the side panels adjacent the bottom panel to hold the heels or bases of the articles in place. In addition, where the articles are bottles, openings are provided in the top panel to hold the necks of the bottles in place.

One problem with such carriers is the fact that they typically are formed from relatively thick paperboard, which adds significantly to the cost of manufacture. Attempts have been made to use thinner and therefore more inexpensive paperboard stock, but this tends to make the carrier too weak and subject to tearing at high stress points. To remedy this tendency, attempts have been made to reinforce the thinner carrier blank or strengthen the most obvious area of stress, the handle of the carrier. Despite whatever success may have been achieved by these or other attempts to use thinner paperboard stock, the strap of carrier material left between the edge of the side panel and the end heel cutout remains a problem area. Even though the handle can be redesigned to overcome the stresses of lifting and carrying a carrier formed from relatively thin paperboard stock, stresses encountered in loading, shipping and unloading have not heretofore been satisfactorily combated. Specifically, this strap portion tends to tear during the sometimes rough handling the carriers receive in shipping, such as when the carriers are drop-loaded in forming a case of four carriers.

The strap portion is a very difficult area to strengthen because the provision of the heel cutouts necessarily results in a thin strap. For example, a bottle carrier for six soft drink bottles typically is $8\frac{3}{4}$ inches long, with cutouts centered on the bottles. Each cutout typically would be about $1\frac{7}{8}$ inches wide at its base, leaving a strap on only $\frac{1}{2}$ inch in width. To make the cutouts smaller so that the strap is wider would be counter to the desire to hold the bottles securely in place, since wide cutouts increase the grip exerted by the edges of the cutouts on the bottles. To attempt to redesign the strap portion to reinforce it would tend to once again increase the cost of the carrier and would not be desirable.

BRIEF SUMMARY OF THE INVENTION

This invention solves the problems discussed above by making a seemingly minor design change in the end cutouts. The width of the end cutouts is decreased very slightly as a result of widening the strap portion without, however, changing the width of the web between the end cutouts and the interior cutouts. This causes the end cutouts to be misaligned with the centerline of their associated bottles, but a further design change involving the contour of the end cutouts overcomes this problem and permits the cutout edges of this arrangement to grip or bite the bottles to hold them in place as before.

These design features can readily be implemented in the standard type of production blank from which the carrier is made, requiring only minor modifications to the black forming die to provide for new cut lines.

Other features and aspects of the invention will be made clear, as well as the various benefits of the invention, in the more detailed description which follows.

BRIEF DESCRIPTION OF THE DRAWINGS

FIG. 1 is a pictorial representation of a wrap-around carrier containing the improved heel cutout features of the present invention;

FIG. 3 is a side elevation of the carrier of the present invention; and

FIG. 4 is a partial side elevation of a typical prior art carrier showing the heel cutout arrangement.

DESCRIPTION OF THE INVENTION

Figure 2:
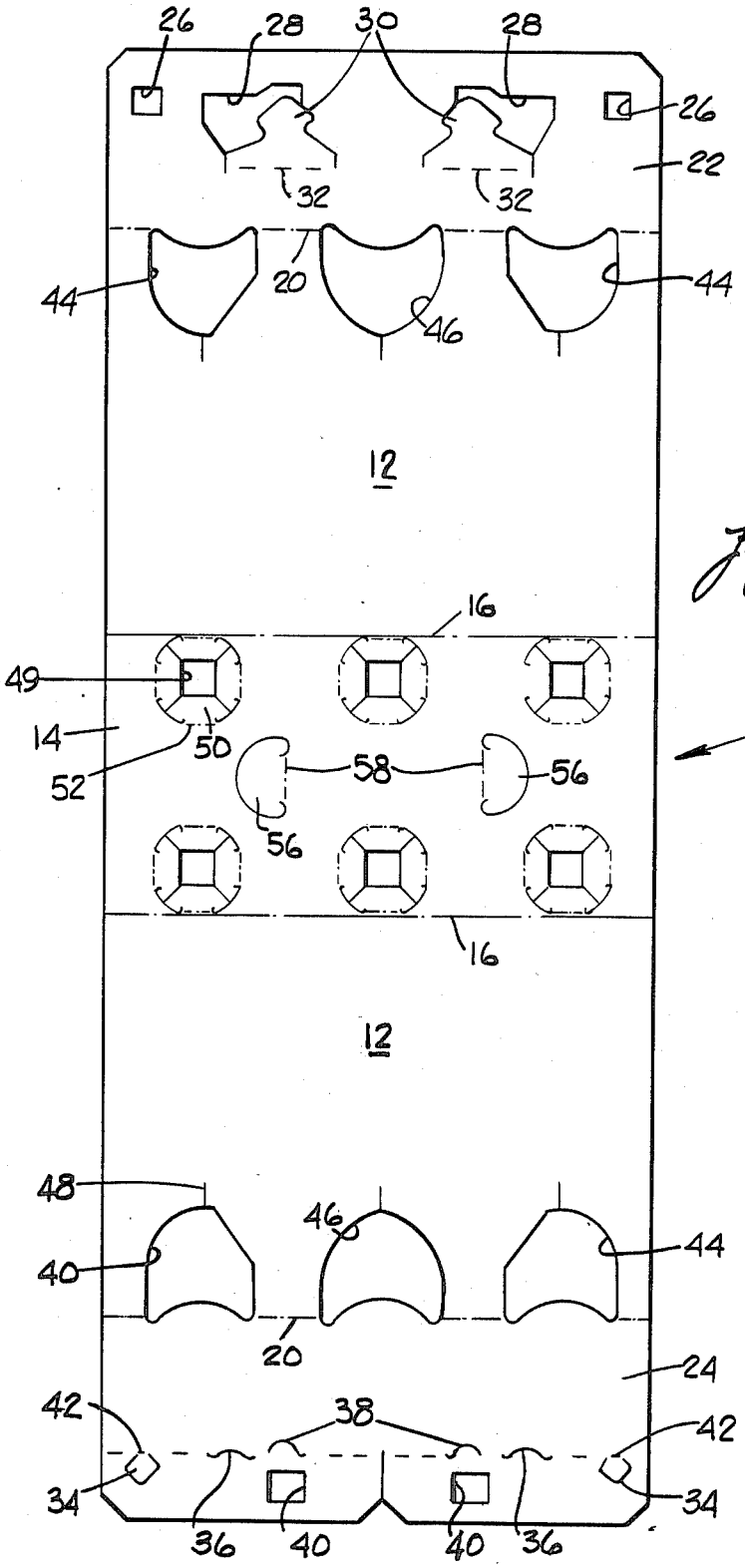
FIG. 2 is a plan view of a production blank used in forming the carrier of the present invention.

Referring first to FIG. 1, a wrap-around carrier 10 comprises side panels 12 foldably connected to top panel 14 by folds 16 and to bottom panel 18 by folds 20. As shown in FIG. 2, the carrier is formed from a single blank 11 whose intermediate sections 12 and central section 14 correspond respectively to side panels 12 and top panel 14 of the carrier 10 of FIG. 1. Score lines 16 of the blank 11 correspond to the folds 16 of the carrier, and score lines 20 of the blank correspond to folds 20 of the carrier.

The bottom panel 18 of the carrier 10 is formed from blank end sections 22 and 24. The end section 22 is shown in FIG. 2 to have cutouts 26 and 28 as well as tabs 30 hingedly connected by score or fold lines 32. The other end section 24 has tabs 34, 36 and 38, and cutouts 40. The tabs 34 are hingedly connected by score or fold lines 42.

In forming the carrier the blank is folded downwardly on all score lines, as viewed in FIG. 2, so that end section 22 overlaps end section 24. End sections 22 and 24 are mechanically interlocked by the insertion of tabs 30 into cutouts 40, tabs 34 into cutouts 26, and tabs 36 and 38 into cutouts 28. These operations are all done by the automatic packaging machine designed to handle the particular type of blank being used and do not form a part of the present invention. Although the locking mechanism described results in a highly satisfactory bottom panel construction, enabling the bottom panel to be selectively locked in place by one or more of the tab and cutout mechanisms in order to accommodate different package perimeters, any arrangement for suitably forming a bottom panel from the end sections of a blank may be used. This invention, therefore, is not limited to any particular bottom panel design.

Still referring to FIGS. 1 and 2, end cutouts 44 and interior cutouts 46, located adjacent score lines 20 in intermediate sections 12 of the blank 11, correspond to openings 44 and 46, respectively, in the side panels 12 of the carrier 10. The bottom cylindrical portions of the articles in the package, which are normally bottles as shown in FIG. 1 at 47, protrude through the cutouts or openings. This common arrangement allows for slight variations in the final package dimensions and serves to hold the bases of the bottles in place. Expansion cuts or slits 48 extend upwardly a short distance from the upper portions of the cutouts to accommodate variations in the diameter of the bottles, the cuts allowing slightly larger diameter bottles to protrude through the heel cutouts to the same extent as slightly smaller diameter bottles due to the yeilding of the side panels adjacent the expansion cuts.

In addition, cutouts 49, located in the central section 14 of the blank 11, correspond to openings 49 in the top panel 14 of the carrier 10 through which the necks of the bottles extend. Tabs 50, adapted to be bent upwardly about score lines 52, surround the neck holes to complete the neck retainer structure. Finger holes 54, formed by bending down tabs 56 about score lines 58, permit the carrier to be lifted and carried. Although shown in some detail, the general carrier construction described thus far is basically conventional in the art.

Referring to FIGS. 3 and 4, the heel cutout arrangement of the present invention, shown in FIG. 3, can best be described by comparing it with the commonly known prior art arrangement shown in FIG. 4. The typical arrangement of FIG. 4 comprises three heel cutouts 60, each one located opposite a bottle in a carrier adapted to carry six bottles. The cutouts are similar in shape, each being generally arch-shaped and substantially symmetrical about an axis which coincides with the centerline of the bottle located at the cutout. The expansion cuts 62 generally coincide with the centerline of the bottles. The dimensions of the cutouts are for the most part dictated by the dimensions of the bottles. The cutouts have to be wide enough for the bases or heels of the bottles to protrude therethrough to an extent which allows the cutout edges to have a maximum of bite or bottle contact. It is obvious that a very narrow cutout would not accomplish this and so would not provide the support needed to hold the bottles in place during the critical period of lifting and carrying. It can be understood that when a carrier is lifted, the side panels of the carrier are placed in tension due to the upward pull on the handle and the downward force exerted by the weight of the bottles. This causes the cutout edges, and particularly the upper edge portions of a cutout, to tend to move inwardly toward the bottles to make a good bite or contact with the bottle. Thus the motivation to make the cutouts large, tempered by the necessity to keep the web portions between the cutouts wide enough to withstand tearing, has resulted in the use of fairly standard dimensions for this type of carrier. For a carrier having a length of $8\frac{3}{4}$ inches (which is basically a function of the diameters of the bottles and the number of bottles in the carrier) the cutouts have been approximately $1\frac{7}{8}$ inches wide with webs 64, approximately 1 1/16 inches wide, separating them. The strap portions 66 between the end heel cutouts and the open end of the carrier have been approximately $\frac{1}{2}$ inch wide.

Referring back to FIG. 3, as a means of illustrating the invention, the preferred dimensions for a carrier of the present invention having a length of $8\frac{3}{4}$ inches are as follows. The interior cutout 46 would be $1\frac{7}{8}$ inches wide, the axis of symmetry of the arch-shaped cutout generally coinciding with the centerline of its associated bottle, the same as the interior cutout of the prior art arrangement. Similarly, the width of the webs would be 1 1/16 inches in order to be assured of adequate tear resistance in this area. The strap portions 70 would have a width of $\frac{5}{8}$ inch, however, instead of the $\frac{1}{2}$ inch dimension of the prior art. While only representing an increase in width of $\frac{1}{8}$ inch, it is in fact an increase of 25%, enough to increase the tear resistance at this point of the carrier so that it is able to withstand the rigors of handling and shipping even when the carrier is formed from paperboard stock significantly thinner than the conventional 23–25 caliper stock. The design of this invention can be used with stock having a caliper of only 18–20 points.

As a result of the wider strap portion, the outer or end heel cutouts would be $\frac{1}{8}$ inch narrower, or $1\frac{3}{4}$ inches wide. The center of the end cutouts is now $\frac{1}{8}$ inch offset from the centerline of its associated bottle in the direction of the interior cutout. Thus the distance from the outer edge of the end cutouts to the centerline of the associated bottle would be 13/16 inch while the distance from the inner edge of the end cutouts to the centerline of the associated bottle would be 15/16 inch. The expansion cut at the top of the cutouts would still generally coincide with the centerline of the bottle.

When the carrier is lifted, the offset cutout arrangement would cause the inner edge of the end cutouts to be separated from the bottle to such an extend that it would be unable to grip or bite the bottle surface when the carrier is lifted. In effect, the extra $\frac{1}{8}$ inch of cutout to the inner side of the bottle centerline creates a gap between the bottle and the inner edge of the end cutouts. To remedy this problem, the inner vertical edge of the end cutouts is connected to the upper portion of the cutout by a chord or straight portion 72. When the carrier is lifted, this straight edge portion can contact the bottle surface even though the width of the cutout is too great for this to theoretically be expected to happen.

Thus by adjusting the end cutout dimensions to provide for a web portion which is less than twice the width of the strap portion, contrasted with the prior art arrangement whereby the web was at least equal to and usually greater than twice the width of the strap portion, and by providing the straight edge portion in the end heel cutouts, the offset cutout arrangement of the present invention provides the necessary bottle bite when the carrier is lifted.

Although described in connection with a carrier adapted to carry six bottles, the same principles could be applied in carriers adapted to carry fewer or more bottles.

It should be obvious that although a preferred embodiment of the invention has been described, changes to certain details can be made without departing from the spirit and scope of the invention as defined in the claims.

What is claimed is:

1. A wrap-around article carrier for carrying two adjacent rows of a predetermined number of adjacent identical articles the bottom portions of which are generally cylindrical in shaped and of predetermined dimensions, comprising:

a top panel;

a bottom panel;

side panels integral with and foldably connected to the top and bottom panels, the side panels having ends corresponding to the ends of the carrier;

the side panels containing a predetermined number of cutouts adjacent the folds connecting the side panels to the bottom panel, the number of cutouts in each side panel corresponding to the number of articles in each row of the articles to be carried by the carrier, each cutout having cut side edge portions and an upper edge portion, the cutouts nearest the ends of the carrier comprising end cutouts, the side edge portions of the end cutouts closest to the ends of the carrier comprising outer side edge portions, the other side edge portions of the end cutouts comprising inner side edge portions;

each cutout being located opposite the predetermined location of one of the articles in the carrier, the dimensions of the carrier and the cutouts being such that a portion of the bottom cylindrical portion of each article carried in the carrier protrudes through an associated cutout;

the end cutouts being located so that planes extending at substantially right angles to the side panels and passing through the predetermined locations of the centerlines of the generally cylindrical portions of articles protruding through the end cutouts are nearer the outer side edge portions of the end cutouts than the inner side edge portions of the end cutouts;

the dimensions and locations of the end cutouts being coordinated with the predetermined dimensions and predetermined locations of the articles protruding through the end cutouts so that such articles touch the inner side edge portions and the outer side edge portions of the cutouts; and the contour of the upper edge portions of the cutouts being such that said upper edge portions are substantially in contact with articles protruding through the cutouts when the carrier is lifted.

2. A wrap-around carrier according to claim 1, wherein the distance between adjacent cutouts is less than twice the distance between the end cutout and the end of the carrier.

3. A wrap-around carrier according to claim 1, wherein the inner side edge portions of the end cutouts are connected to the upper edge portions of said cutouts by a straight edge portion extending at an acute angle to the bottom panel.

4. A wrap-around article carrier for carrying two adjacent rows of a predetermined number of adjacent identical articles the bottom portions of which are generally cylindrical in shape and of predetermined dimensions, comprising;

a top panel;

a bottom panel;

side panels integral with and foldably connected to the top and bottom panels, the side panels having ends corresponding to the ends of the carrier;

the side panels containing a predetermined number of cutouts adjacent the folds connecting the side panels to the bottom panel, the number of cutouts in each side panel corresponding to the number of articles in each row of the articles to be carried by the carrier, each cutout having side edge portions and an upper edge portion, the cutouts nearest the ends of the carrier comprising end cutouts, the side edge portions of the end cutouts closest to the ends of the carrier comprising outer side edge portions, the other side edge portions of the end cutouts comprising inner side edge portions;

each cutout being located opposite the predetermined location of one of the articles in the carrier, the dimensions of the carrier and the cutouts being such that a portion of the bottom cylindrical portion of each article carried in the carrier protrudes through an associated cutout;

the end cutouts being located so that planes extending at substantially right angles to the side panels and passing through the predetermined locations of the centerlines of the generally cylindrical portions of articles protruding through the end cutouts are nearer the outer side edge portions of the end cutouts than the inner side edge portions of the end cutouts;

the contour of the upper edge portions of the cutouts being such that said upper edge portions are substantially in contact with articles protruding through the cutouts when the carrier is lifted;

the distance between adjacent cutouts being less than twice the distance between the end cutout and the end of the carrier;

the outer side edge portion of each of the end cutouts being connected to the upper edge portion of said end cutout to generally form a half-arch, the inner side edge portion of each said end cutout being connected to the upper edge portion of said end cutout by a straight portion extending at an acute angle to the bottom panel.

5. A wrap-around carrier according to claim 4, wherein the side panels further contain an expansion cut extending upwardly from the upper edge portion of each cutout for a relatively short distance, each expansion cut being substantially aligned with a plane extending at substantially right angles to side panels and passing through the centerline of the cylindrical portion of an article protruding through its associated cutout.

6. A wrap-around carrier according to claim 4, wherein the articles are bottles and the top panel contains openings through which the necks of the bottles extend.

7. A wrap-around carrier according to claim 4, wherein each side panel contains at least three cutouts, each interior cutout located between the end cutouts being generally arch-shaped and substantially symmetrically arranged with respect to a plane extending at substantially right angles to the side panels and passing through the centerline of an article protruding through each said interior cutout.

8. A production blank adapted to be folded to form a wrap-around article carrier for carrying two adjacent rows of a predetermined number of adjacent identical articles the bottom portions of which are generally cylindrical in shape and of predetermined dimensions, comprising:

sheet material in the general shape of a rectangle;

the sheet having a central section intended to become the top panel of the carrier, end sections adapted to be connected together to form the bottom panel of the carrier, and intermediate sections connected to the central and end sections by score lines and intended to become the side panels of the carrier, the intermediate sections having side edges intended to become the ends of the carrier;

the intermediate sections containing a predetermined number of cutouts adjacent the score lines connecting the intermediate sections to the end sections, the number of cutouts in each intermediate section corresponding to the number of articles in each row of articles to be carried by a carrier formed from the blank, each cutout having side edge portions and an upper edge portion, the cutouts nearest the side edges of the intermediate sections comprising end cutouts, the side portions of the end cutouts closest to the side edges of the intermediate sections comprising outer side edge portions, the other side edge portions of the end cutouts comprising inner side edge portions;

each cutout being located opposite the predetermined location of one of the articles to be carried in a carrier formed from the blank, the dimensions of the blank and the cutouts being such that a portion of the bottom cylindrical portion of each article in a carrier formed from the blank protrudes through an associated cutout;

the end cutouts being located so that planes extending at substantially right angles to the sheet and passing through the predetermined locations of the centerlines of the generally cylindrical portions of articles protruding through the end cutouts of a carrier formed from the blank are nearer the outer side edge portions of the end cutouts than the inner side edge portions of the end cutouts;

the distance between adjacent cutouts being less than twice the distance between the side cutout and the side edge of the sheet;

the outer side edge portion of each of the end cutouts being connected to the upper edge portion of said end cutout to generally form a half-arch, the inner side edge portion of each said end cutout being connected to the upper edge portion of said end cutout by a straight portion extending at an acute angle to the bottom panel of a carrier formed from the blank.

9. A production blank according to claim 8, wherein the intermediate sections contain an expansion slit extending for a short distance from each cutout toward the central section, each expansion slit being arranged to be aligned with a plane extending at substantially right angles to the sheet and passing through the predetermined location of the centerline of the cylindrical portion of an article protruding through the associated cutout of a carrier formed from the blank.

10. A production blank according to claim 9, wherein the carrier formed from the blank is adapted to carry bottles and wherein the central section of the blank contains openings adapted to receive the necks of the bottles.

11. A production blank according to claim 10, wherein at least the upper edges of the cutouts are adapted to be in substantial contact with the bottles carried by a carrier formed from the blank when the carrier is lifted.

12. A production blank according to claim 8, wherein each intermediate section contains at least three cutouts, each interior cutout located between the end cutouts being generally arch-shaped and substantially symmetrically arranged with respect to a plane extending at substantially right angles to the sheet and passing through the predetermined location of the centerline of an article protruding through each said interior cutout after the blank has been formed into a carrier and loaded with the articles.

* * * * *